United States Patent [19]

Collins

[11] 3,930,309

[45] Jan. 6, 1976

[54] RING LOCK KNIFE

[76] Inventor: Walter W. Collins, 273 E. Paces Ferry Road, Atlanta, Ga. 30305

[22] Filed: May 30, 1974

[21] Appl. No.: 474,389

[52] U.S. Cl. ..... 30/161
[51] Int. Cl.[2] ..... B26B 1/04
[58] Field of Search ..... 30/155, 156, 157, 161, 30/160

[56] References Cited

UNITED STATES PATENTS

| | | | |
|---|---|---|---|
| 459,056 | 9/1891 | Truax | 30/161 X |
| 592,426 | 10/1897 | Meyer | 30/161 |
| 684,016 | 10/1901 | Weidknecht | 30/161 |
| 727,724 | 5/1903 | Weil | 30/161 |
| 1,182,043 | 5/1916 | Schless | 30/157 |
| 2,559,993 | 7/1951 | Parrigin | 30/161 X |
| 3,061,927 | 11/1962 | Ludwigsdorf | 30/156 |

*Primary Examiner*—Al Lawrence Smith
*Assistant Examiner*—J. C. Peters
*Attorney, Agent, or Firm*—Jones, Thomas & Askew

[57] ABSTRACT

The knife has a slotted handle and a blade that pivots into and out of the slot of the handle. A free floating pivot pin extends through the slotted end of the handle and through the opening of the tang of the blade, and a slotted ring lock extends about the pivot pin. The ring lock is rotatable on the handle so that its slot is movable into and out of alignment with the slot of the handle, to lock the blade with respect to the handle. The periphery of the tang defines hemispherical indentations, and a spring-urged ball in the handle engages the tang and registers with the indentations so that the blade resists movement when in its folded or extended positions but is free to move when intermediate the end positions.

7 Claims, 6 Drawing Figures

RING LOCK KNIFE

BACKGROUND OF THE INVENTION

The conventional knife with a folding blade can be conveniently carried and handled since the blade of such a knife can be inserted into the slot of the handle, where the cutting edge and tip of the blade are shielded and the knife is effectively shorter. The conventional folding knife usually requires the presence of a rigidly fixed blade pivot pin which extends through the blade-receiving slot of the handle, and the blade pivots about the pivot pin. The pivot pin is usually peened at its ends to make the ends larger so as to form a friction fit with the handle. As the knife is used, the pivot pin usually works loose from the layers of the handle structure so that the blade-receiving slot of the handle becomes slightly larger and the blade develops an undesirable lateral looseness or wobble with respect to the handle. The handle of the conventional folding knife also usually has a leaf spring biased against each blade tang to urge each blade toward its opened or closed positions and to keep the blade from moving freely with respect to the handle. While it is desirable to maintain a degree of stiffness between the blade and handle to keep the blade from floating, it is hazardous to have the blade biased toward its opened or closed positions. It is desirable to have the blade seek its opened and closed positions when being moved toward and approaching one of these positions, and it is desirable to lock the blade in its opened position to remove the hazard of having the blade inadvertantly close on the fingers of the user.

SUMMARY OF THE INVENTION

Briefly described, the present invention comprises a folding knife which includes a blade pivotally mounted on a pivot pin in a slotted handle so that the sharpened edge and tip of the blade can be folded into the slot of the handle or the blade can be folded out into its opened position where it is coextensive with the handle. The tang of the blade has a rounded peripheral portion, and a pair of hemispherical indentations are formed in the peripheral portion of the tang on opposite sides of the pivot pin. A spring-urged ball is mounted in a cavity within the handle, and the spring urges the ball into contact with the peripheral portion of the tang, so that the ball registers with an indentation of the tang when the blade is in its fully opened or fully closed positions. A slotted ring lock is mounted on the handle about the pivot pin and tang, and the ring lock is rotatable with respect to the handle so that its slot is movable into and out of alignment with the slot of the handle and the blade, to alternately allow passage of the blade as it is folded with respect to the handle or to lock the blade in its opened position with respect to the handle.

The handle is formed from investment casting and its back and side plates are of unitary construction so that a rigid mounting is provided for the blade.

Thus, it is an object of the present invention to provide an improved folding knife which is inexpensive to manufacture, which is convenient to use, which is durable, and which includes a locking mechanism for locking the blade in its opened position with respect to the handle.

Other objects, features, and advantages of the present invention will become apparent upon reading the following specification, when taken in conjunction with the accompanying drawing.

DESCRIPTION OF A PREFERRED EMBODIMENT

Figure 1:
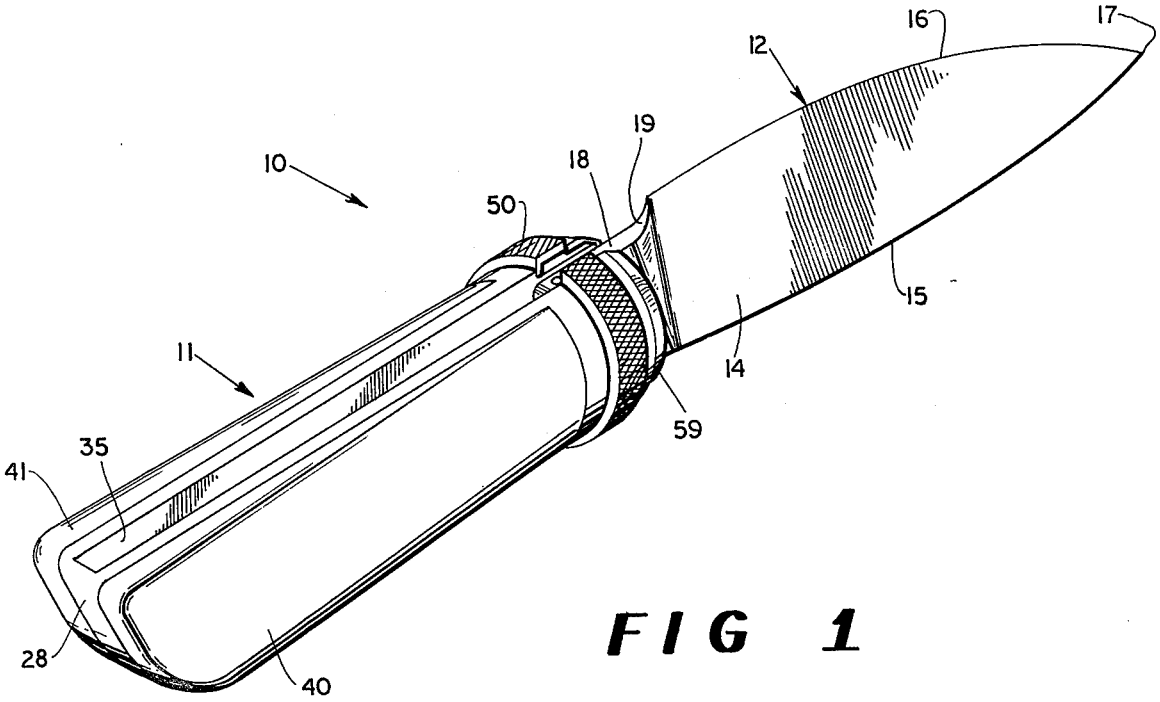
FIG. 1 is a perspective view of the knife with the blade in its opened position.
Figure 2:
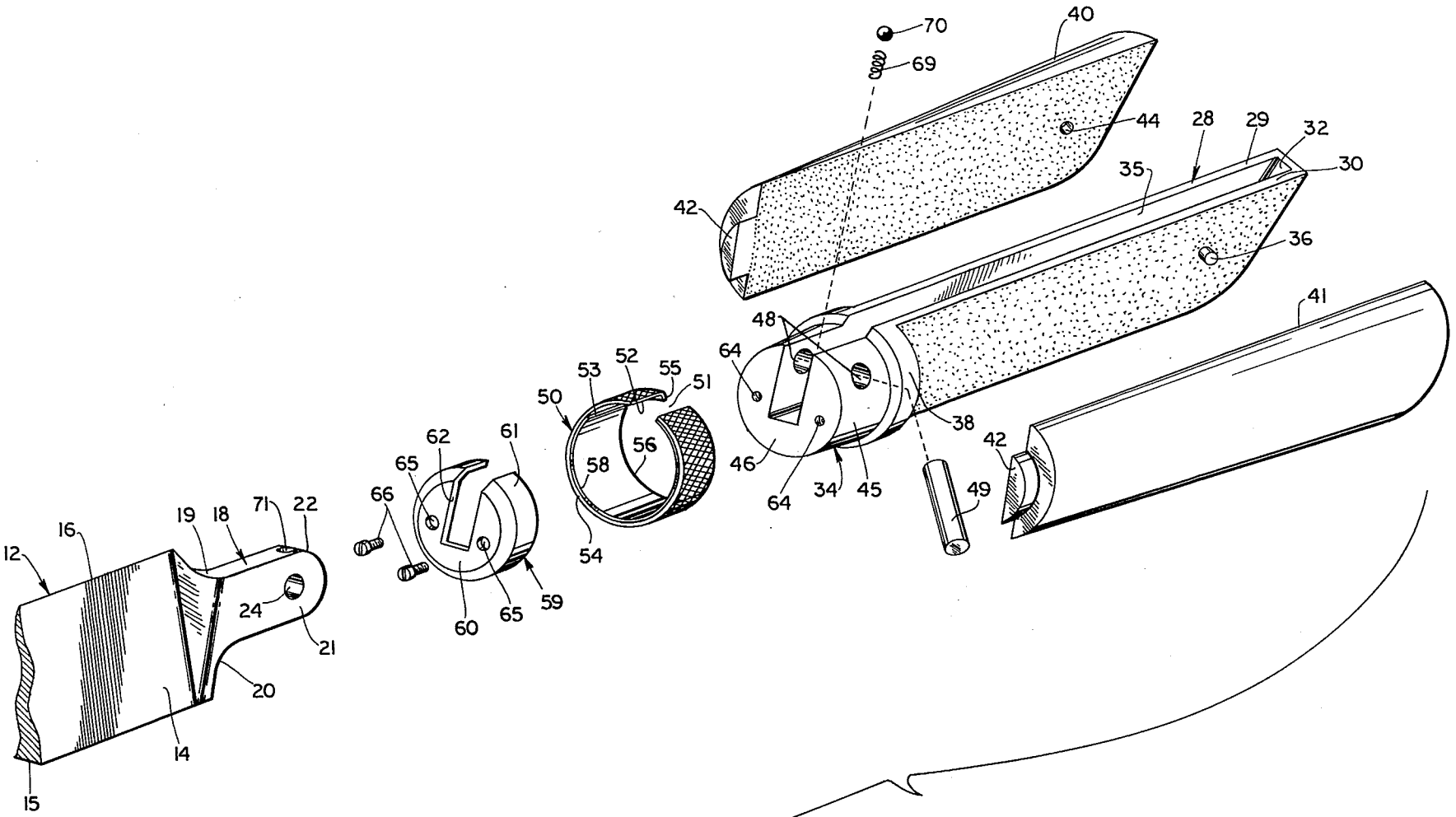
FIG. 2 is an exploded perspective view of the knife, with a portion of the blade removed for clarity.

Referring now in more detail to the drawing, wherein like views indicate like parts throughout the several views, FIG. 1 illustrates the knife 10 which includes handle assembly 11 and blade 12. Blade 12 includes main body portion 14, back 15, sharpened cutting edge 16, tip 17 at its distal end, and tang 18. As is illustrated in FIG. 2, tang 18 is of smaller width than the main body portion of blade 12 and includes a concave wedge-shaped upper shoulder 19 and the lower shoulder 20 which merge from the sharpened cutting edge 16 and back 15 to form a body portion 21 having substantially flat opposite sides and a curved or rounded peripheral portion 22. Circular aperture 24 extends centrally through the body portion 21, and the radius of curvature of the rounded portion 22 of the tang finds its center at the center of aperture 24.

Handle assembly 11 includes a unitary inner handle structure 28 which is formed from investment casting. Inner handle 28 includes side walls 29 and 30, inner wall 31 (FIG. 6), end wall 32 and end bushing or bolster 34 at the head portion of the handle. A rectilinear slot 35 is defined by the side walls, inner wall and end wall and extends along the length of the inner handle and through the bolster 34. The depth of slot 35 is sufficient to accommodate a major portion of the width of the blade when the blade is folded into the slot, and the slot is of lesser depth in bolster 34 (FIG. 6), where it is of a depth approximately equal to the width of tang 18 of blade 12.

The outside or external surface of side walls 29 and 30 of inner handle 28 are substantially flat and a protrusion 36 extends outwardly from the surface of each side wall adjacent the end wall 32. A semi-circular shoulder 38 is formed about the external surface of inner handle 28 at the slotted end portion of the handle, rearwardly of bolster 34. The semi-circular shoulder is undercut (not shown) on opposite sides of the inner handle adjacent the flat exterior surfaces of the side walls 29 and 30.

Outer handle sections 40 and 41 are mounted on the exterior flat surfaces of side walls 29 and 30 of inner handle 28. Each outer handle section 40 and 41 includes a tongue 42 insertable into the undercut portion (not shown) of the semicircular shoulder 38 and a bore 44 insertable over the protrusion 36 of the inner handle 28. An adhesive is applied to the facing surfaces of the outer handle sections 40 and 41 and the external flat surfaces of inner handle side walls 29 and 30 so that the outer handle sections 40 and 41 are rigidly secured to the inner handle. The tongue and groove fit of the outer handle sections with the inner handle and the mounting of the outer handle sections about the protrusions 36 causes the outer handle sections to be highly shear resistant with respect to the inner handle.

Bolster 34 of inner handle 28 has a slotted cylindrical exterior surface 45 and a flat slotted end surface 46. Pivot pin aperture 48 extends through bolster 34 and intersects slot 35 inside the handle and the cylindrical surface 45 at the external surface of the bolster 34. Pivot pin 49 extends through pivot pin aperture 48. Pivot pin 49 is of a diameter only slightly smaller than pivot pin aperture 48 and of a length slightly shorter than the shortest length of pivot pin aperture 48. Pivot pin 49 is therefore rotatable about its longitudinal centerline within the pivot pin aperture and can be shifted along its centerline within the aperture. The aperture 24 of tang 18 of blade 12 is of a diameter approximately equal to the diameter of pivot pin aperture 48. Tang 18 is inserted into the slotted end portion of inner handle 28 so that its aperture 24 registers with the pivot pin aperture 48 of the handle, and pivot pin 49 is inserted through the aligned apertures 24 and 48 to hold the blade in a pivotable relationship with respect to the handle.

Ring lock 50 is approximately circular or sleeve-shaped and defines open slot 51 which is approximately equal in width to the width of slot 35 of inner handle 28. The internal diameter of ring lock 50 is only slightly larger than the external diameter of bolster 34, so that ring lock 50 can be inserted over bolster 34, against the semi-circular shoulder 38 of inner handle 28.

An undercut arcuate section 52 is defined on the inner face of ring lock 50 and intersects the front edge 54 and the slot 51. The length of undercut section 52 from slot 51 to its shoulder 53 is slightly longer than the width of slot 35 of inner handle 28 and its width does not extend the full width of ring lock 50, leaving an inwardly extending arcuate protrusion 55 at the rear edge 56 of the ring lock. The protrusion 55 is coextensive with the curved inner surface 58 of the ring lock.

Retaining cap 59 is mountable on bolster 34. Retaining cap 59 includes a slotted disc portion 60 and slotted flange 61. The inside diameter of flange 61 is only slightly larger than the outside diameter of bolster 34, so that retaining cap fits about the end portion of bolster 34. The slot 62 is approximately equal in width to the width of slot 35 of inner handle 28, and slot 62 is slightly deeper than the depth of slot 35 at bolster 34.

The flat end surface 46 of bolster 34 defines internally threaded bores 64 on opposite sides of slot 35, and apertures 65 are formed in retaining cap 59. When retaining cap 59 is inserted about the bolster 34, the apertures 65 will register with the internally threaded bores 64 of the bolster. Capscrews 66 are provided for rigidly securing endcap 59 to the end surface 46 of bolster 34.

Figure 6:
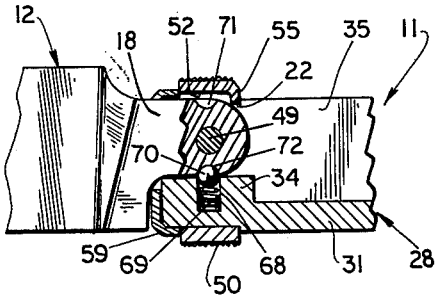
FIG. 6 is a side cross-sectional view of the knife at the hinge pin, with portions of the blade and handle removed for clarity.

As is illustrated in FIG. 6, slot 35 is deeper in the main portion of inner handle 28, and the depth of the slot decreases in the vicinity of bolster 34. Blind bore 68 is formed in the inner bottom surface of bolster 34, and coil compression spring 69 is seated in the bore 68. Ball 70 is mounted on coil compression spring 69 and is urged by the spring out of bore 68 into engagement with the rounded peripheral portion 22 of tang 18.

A pair of hemispherical indentations 71 and 72 are formed in the rounded peripheral portion 22 of tang 18 on diametrically opposite sides of aperture 24 and pivot pin 49. The radius of curvature of the hemispherical indentations 71 and 72 is only slightly larger than the radius of curvature of ball 70. Thus, the fit between ball 70 and its hemispherical indentations in tang 18 is such that the ball tends to hold blade 12 steady with respect to handle assembly 11. Moreover, since the radius of curvature of rounded peripheral portion 22 of tang 18 is constant, the force exerted by ball 70 against the rounded peripheral portion 22 of the tang tends to steady the blade and keep it from collapsing with respect to the handle assembly, but the blade is not biased either toward its closed or opened positions with respect to the handle until the ball 70 begins to register with either of the hemispherical indentations 71 or 72.

Figure 3:
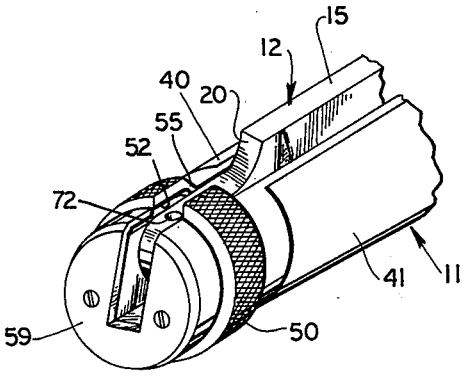
FIGS. 3, 4 and 5 are perspective views of the slotted end portion of the handle of the knife, with portions of the blade and handle removed for clarity.
Figure 4:
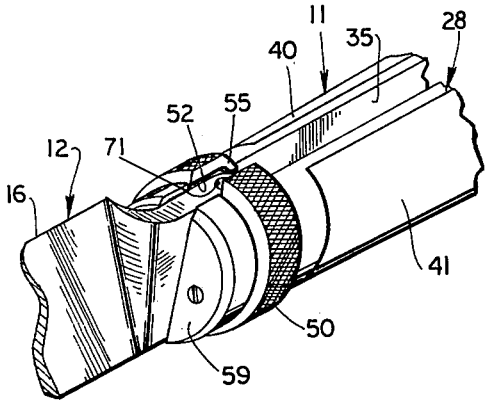
Figure 5:
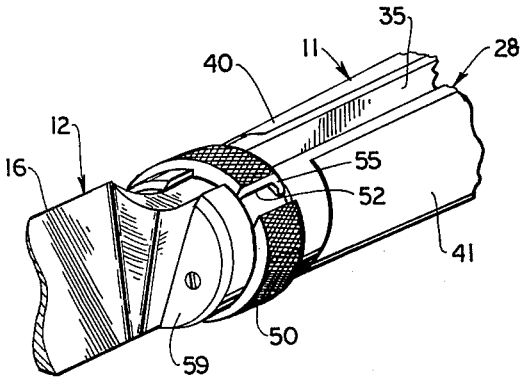

As is best illustrated in FIGS. 3, 4 and 5, when blade 12 is in its folded position with respect to handle assembly 11, the sharpened cutting edge of the blade will be located deep within slot 35. The ball 70 (FIG. 6) will be urged into the hemispherical indentation 71 of the tang so that the blade will tend to remain in its folded position. When the blade 12 is pulled out of the slot 35 of the handle assembly 11, the blade will initially offer some resistance to unfolding from the handle since the tang must push the ball 70 out of the recess of the indentation 71, but once the indentation 72 of the tang is completely out of registry with the ball 70, the blade will easily fold away from the slot of the handle toward its open position. If the blade is released between its fully opened or fully closed positions, it will tend to remain in a static relationship with respect to the handle since the ball 70 will be continuously biased into engagement with the rounded peripheral portion 22 of the tang 18. As the blade continues to pivot about pivot pin 49 toward its extended or open position, the hemispherical indentation 72 will begin to register with ball 70, so that the blade will tend to snap into its open position.

When blade 12 is fully opened, it is possible to rotate ring lock 50 about bolster 34 in one direction only. Bolster 34 thus functions as a bushing both for ring lock 50 and for pivot pin 49. The undercut section 52 of ring lock 50 is of a large enough diameter to move over the tang of the blade, and the inwardly extending arcuate protrusion 55 of the ring lock is able to pass over the narrower rounded peripheral portion of the tang. The ring lock 50 can be rotated until the shoulder 53 of the undercut portion 52 engages the tang. The undercut section 52 is of a length sufficient to allow the unslotted portion of the rotatable ring lock to completely cover the slot portion of the rotatable ring lock to completely cover the slot 35 of handle assembly 11, but is insufficient to allow the open slot 55 to register with the pivot pin aperture 48 of bolster 34. Thus, pivot pin aperture 48 is always covered by ring lock 50 and the pivot pin will never be lost through slot 55. Ring lock 50 therefore functions as a retaining means to retain pivot pin 49 inside its pivot pin aperture.

When ring lock 50 is rotated so that its slot 51 is out of registry with the slot 35 of handle assembly 11 and the plane of blade 12, the blade 12 is locked in its opened position with respect to handle assembly 11. When ring lock 50 is rotated in the opposite direction so that its slot 55 registers with slot 35 of the handle assembly, the blade can be folded into the slot. When the blade is folded into its slot, as illustrated in FIG. 3, the inwardly extending arcuate protrusion 55 of the ring lock cannot move across tang 18 since the portion of the tang 18 adjacent the arcuate protrusion 55 extends above the inner surface of the arcuate protrusion. Thus, the blade 12 of the knife can be locked in its opened position, but cannot be locked in its closed position by ring lock 50.

While this invention has been described in detail with particular reference to preferred embodiments thereof, it will be understood that variations and modifications can be effected within the spirit and scope of the invention as described hereinbefore and as defined in the appended claims.

I claim:

1. A knife comprising a handle defining a blade slot extending along its length and through an end portion thereof, a pivot pin aperture extending through the slotted end portion of said handle, a blade including an apertured tang, said apertured tang positioned in the blade slot of said handle with its aperture in alignment with said pivot pin aperture, a pivot pin extending through the aperture of said tang and the pivot pin aperture of said handle, said pivot pin being movable along its length and rotatable about its longitudinal axis in the pivot pin aperture of said handle, a slotted ring lock rotatably mounted on and extending about the slotted end of said handle over the ends of said pivot pin, whereby the ring lock confines the pivot pin in the handle and the blade is pivotable about the pivot pin between a closed position where an edge portion thereof is located in the slot of the handle and an open position where it is coextensive with the handle.

2. The knife as set forth in claim 1 and wherein said slotted ring lock is rotatable about the handle only when the blade is open and coextensive with the handle whereby the slot of the bolster is movable out of alignment with the slot of the handle to lock the blade open with respect to the handle.

3. The knife as set forth in claim 1 and wherein the tang of said blade defines a pair of indentations therein on opposite sides of the aperture of the tang, and wherein the handle includes a movable protrusion and spring means biasing said protrusion toward engagement with the path of the indentations as the blade is pivoted in the handle, whereby the protrusion becomes biased in one of the indentations to releasably hold the blade in a fixed position with respect to the handle.

4. The knife of claim 1 and wherein said tang defines a rounded peripheral portion and hemispherical indentations are formed on opposite sides of the aperture of the tang in its rounded peripheral portion, and wherein said handle includes a bore at its slotted end portion, a spring seated in said bore, and a ball seated on said spring and biased by said spring into engagement with the rounded peripheral portion of said tang, whereby the ball registers with the indentations of the tang when the blade is pivoted with respect to the handle.

5. A knife comprising a handle defining a blade-receiving slot extending along its length and through one end portion thereof, a blade including a tang pivotally mounted in the blade slot of the slotted end portion of said handle and said blade being movable between a closed position with an edge in said blade slot and an opened position where it is coextensive with said handle, said tang being rounded about its end away from the distal end of the blade, and a sleeve-shaped ring lock rotatably mounted about the slotted end portion of said handle, said ring lock defining an open slot alignable with the blade slot of said handle and including an undercut arcuate section exetnding from its slot and the front edge of the ring lock about a portion of its inner surface, and an inwardly extending arcuate protrusion adjacent the undercut section at the rear edge of the ring lock, whereby when the blade is opened from the handle where it is coextensive with the handle, the ring lock is rotatable about the slotted end portion of the handle with its undercut arcuate section movable over the tang of the blade and the inwardly extending arcuate protrusion movable over the rounded end portion of the tang, and when the blade is closed into the blade slot of the handle, the ring lock is not rotatable about the slotted end portion of the handle since the inwardly extending arcuate protrusion cannot move over the tang of the blade.

6. A knife comprising a handle defining a blade receiving a slot extending along its length and through an end portion thereof, a blade including a tang inserted into the slotted end portion of said handle, the slotted end portion of said handle and the tang of said blade each defining aligned openings, and a pivot pin positioned in said aligned openings, said pivot pin being movable along its longitudinal axis with respect to said handle, a ring lock rotatably mounted on the slotted end portion of said handle about the ends of said pivot pin and confining said pivot pin in said aligned openings, said ring lock defining a slot therein rotatable into and out of alignment with the blade-receiving slot of said handle, and means for limiting the rotation of said ring lock with respect to said handle whereby the slot of the ring lock does not move into alignment with said pivot pin.

7. In a knife structure comprising a handle and a blade foldably connected to one end portion of the handle, the improvement therein of said handle including a unitary inner handle with side walls and a back wall extending along its length and defining a blade receiving slot and an approximately cylindrical head portion at one end, said slot extending through said head portion at a depth less than the depth at which it is formed between said side walls, a blade pivot pin supported at its ends in said head portion and extending through said slot and movable along its longitudinal axis through said head portion, said head portion defining a spring bore therein, a coil compression spring mounted in said spring bore and a ball member positined between said spring and said blade and biased by the spring into engagement with said blade to yieldably restrain the movement of the blade with respect to the handle, and a ring lock defining a slot therein rotatably mounted on and extending about said approximately cylindrical head portion of said handle and about the ends of said pivot pin and about said coil compression spring, said ring lock being rotatably about said handle to register its slot with the blade receiving slot of said handle to permit the blade to fold through its slot or to move its slot out of registration with the blade receiving slot of said handle to lock the blade with respect to said handle, and means for limiting the rotation of said ring lock with respect to said handle whereby the slot of the ring lock does not move into alignment with said pivot pin.

* * * * *